US006111547A

United States Patent [19]

Gau et al.

[11] Patent Number: 6,111,547

[45] Date of Patent: Aug. 29, 2000

[54] MODULARIZED MULTIPLE-FEED ELECTROMAGNETIC SIGNAL RECEIVING APPARATUS

[75] Inventors: Jiahn-Rong Gau; Cheng-Geng Jan; Hsin-Tang Liu; Cheng-Nan Lee, all of Hsinchu, Taiwan

[73] Assignees: Texas Instruments-Acer Incorporated; Hsinchu Science-Based Industrial Park, both of Taiwan

[21] Appl. No.: 09/170,000

[22] Filed: Oct. 13, 1998

[51] Int. Cl.[7] ..... H01Q 13/00

[52] U.S. Cl. ..... 343/786; 343/781 R; 343/776

[58] Field of Search ..... 343/786, 775, 343/776, 779, 878, 884, 781 R, 782; H01Q 13/00

[56] References Cited

U.S. PATENT DOCUMENTS 5,517,203 5/1996 Fiedziuszko ..... 343/756
5,812,096 9/1998 Tilford ..... 343/761 R

*Primary Examiner*—Hoanganh Le
*Assistant Examiner*—Shih-Chao Chen
*Attorney, Agent, or Firm*—Winston Hsu

[57] ABSTRACT

This invention is a compact and cost effective multiple-feed signal receiver for use in conjunction with a parabolic dish antenna to receive electromagnetic signals from more than one satellite clusters. The multiple-feed signal receiver has a multi-layer structure to integrate circuit boards for different frequency bands or the same frequency band for different signal processing within a limited cross-section and to isolate these boards from signal interference with one another.

18 Claims, 4 Drawing Sheets

MODULARIZED MULTIPLE-FEED ELECTROMAGNETIC SIGNAL RECEIVING APPARATUS

BACKGROUND OF THE INVENTION

1. Field of the Invention

This invention relates generally to electromagnetic signal receiving devices, and more particularly to a multi-feed signal receiving device having a plurality of waveguide assembly and circuit layers for processing microwave signals.

2. Description of the Prior Art

Direct Broadcast Satellite (DBS) is a point-to-multipoint system in which individual households equipped with a small receiving antenna and tuner device receive broadcasts directly from a geostationary satellite. The satellite receives digital audio and video transmissions from ground stations and relays them directly to individuals. The receiving antenna is comprised of a parabolic dish designed to collect the satellite signals and focus them at the focal point, where an LNBF (Low Noise Block with integrated Feed) module is mounted to convert the incoming signals to a lower frequency band and transmit it to a tuner device. The LNBF module also acts as a filter and an amplifier-to selectively boost the signal received by the dish collector. The LNBF module comprises a feed for receiving microwave signals and circuitry for processing the received microwaves.

FIG. 1 shows the various parts of a prior art single-feed LNBF module. The LNBF module comprises a signal feed, a cylindrical waveguide, a signal processing module, and an output connector. Microwave signals are received by the signal feed and transmitted to the signal processing module through the waveguide. A cap is mounted in front of the signal feed to provide protection from dust and rain. The signal processing module is enclosed in a housing, and comprises probe pins coupled the waveguide energy to a printed circuit board. One typical probe pin structure is an L-type probe pin. A round opening is provided on the front end of the housing to allow microwave signals in the cylindrical waveguide to be coupled to the L-type probe pin.

The L-type probe pin couples the microwave signals to a processing circuitry on the printed circuit board. A spacer is provided at the back end of the printed circuit board to provide signal isolation and electric shielding. Typically, the processing circuitry provides amplification and frequency conversion functions. The microwave signals are converted to an intermediate frequency suitable for propagation in transmission cables. An output connector couples the amplified and frequency-converted signals to a transmission cable. The signals are then transmitted to a set top box or a signal decoder for further processing.

Normally, each satellite dish antenna is aligned to receive signals from a particular cluster (or group) of satellites in a certain direction. Microwave signals aligned to the axis of the parabolic antenna dish are collected at the focal point, where the LNBF module is located. When receiving signals from different satellite clusters, multi-feed LNBF modules are used. The multiple feeds of the LNBF module are placed closely together, and configured to allow signals from each satellite to be collected by the dish collector to the corresponding feeds. The signals are amplified and demodulated on a circuit board having microstrip lines and various electronic components. Because it is difficult to integrate electronic components in a single circuit board for different frequency bands and provide for different signal processing and prevent interference, a plurality of LNBF modules are used to process the signals individually. These LNBF modules are placed side-by-side, and a number of waveguides are required to guide the microwave signals from the signal feeds to the disparate LNBF modules. Such a configuration results in a large, complex, and expensive apparatus.

SUMMARY OF THE INVENTION

What is needed, therefore, is a compact and efficient signal receiving apparatus that can discriminate the signals and reduce signal interference from a plurality of different sources.

The present invention provides a signal receiving apparatus for receiving electromagnetic signals transmitted from at least two distinct sources. The signal receiving apparatus comprises antenna means for collecting the electromagnetic signals from the at least two sources, at least two signal feeds for receiving the electromagnetic signals collected by the antenna means, and signal processing means for processing the electromagnetic signals received by the at least two signal feeds. The signal processing means includes at least two circuit boards for respectively processing the electromagnetic signals from each of the at least two signal feeds, and at least one spacer layer, disposed between the circuit boards, for reducing interference between the circuit boards.

One advantage of the present invention is to provide a compact and cost effective multiple-feed signal receiver for use in conjunction with a parabolic dish antenna to receive signals from more than one satellite clusters.

Another advantage of the present invention is to provide a compact multiple-feed signal receiver having multi-layer structure to integrate circuit boards for different frequency bands or same frequency band for different signal processing within a limited cross-section and to isolate these boards from signal interference with one another.

Other features, advantages and embodiments of the invention will be apparent to those skilled in the art from the following description, accompanying drawings and appended claims.

DESCRIPTION OF THE INVENTION

The present invention provides a multi-feed signal receiver for receiving signals emanating from two or more satellites (or satellite clusters). The signal receiver comprises signal feeds for feeding signals to a circuit module for processing of the signals. For clarity of description, an LNBF (Low Noise Block with integrated Feed) is used as an illustration of an embodiment. The term LNBF is used for purposes of illustration only, and does not limit the scope of the present invention.

In the following description, for simplicity, whenever convenient, similar components will have the same numbering labels.

Figure 1:
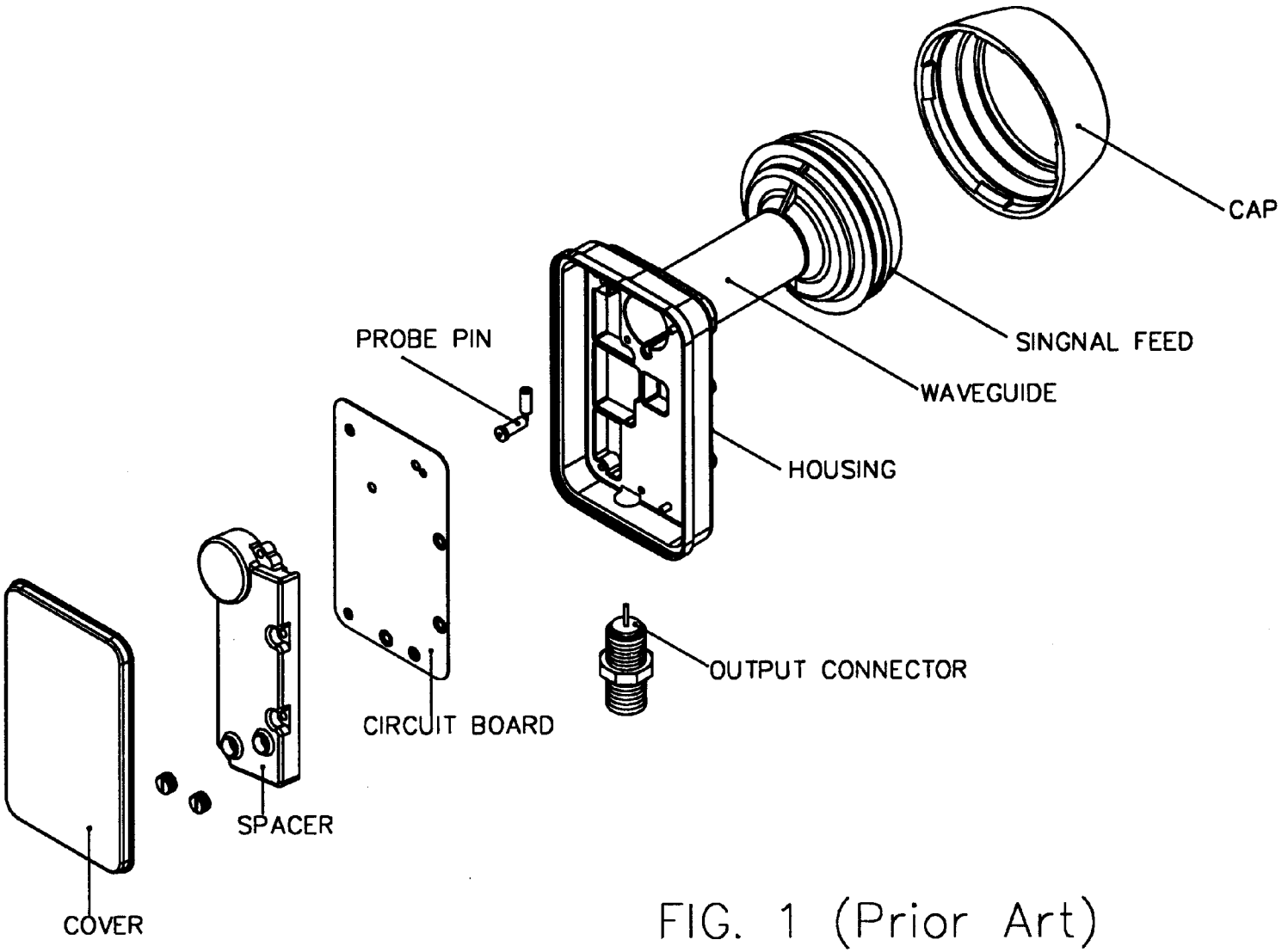
FIG. 1 (Prior Art)
FIG. 1 is an exploded view of a prior art LNBF module utilizing a single circuit layer.
Figure 2:
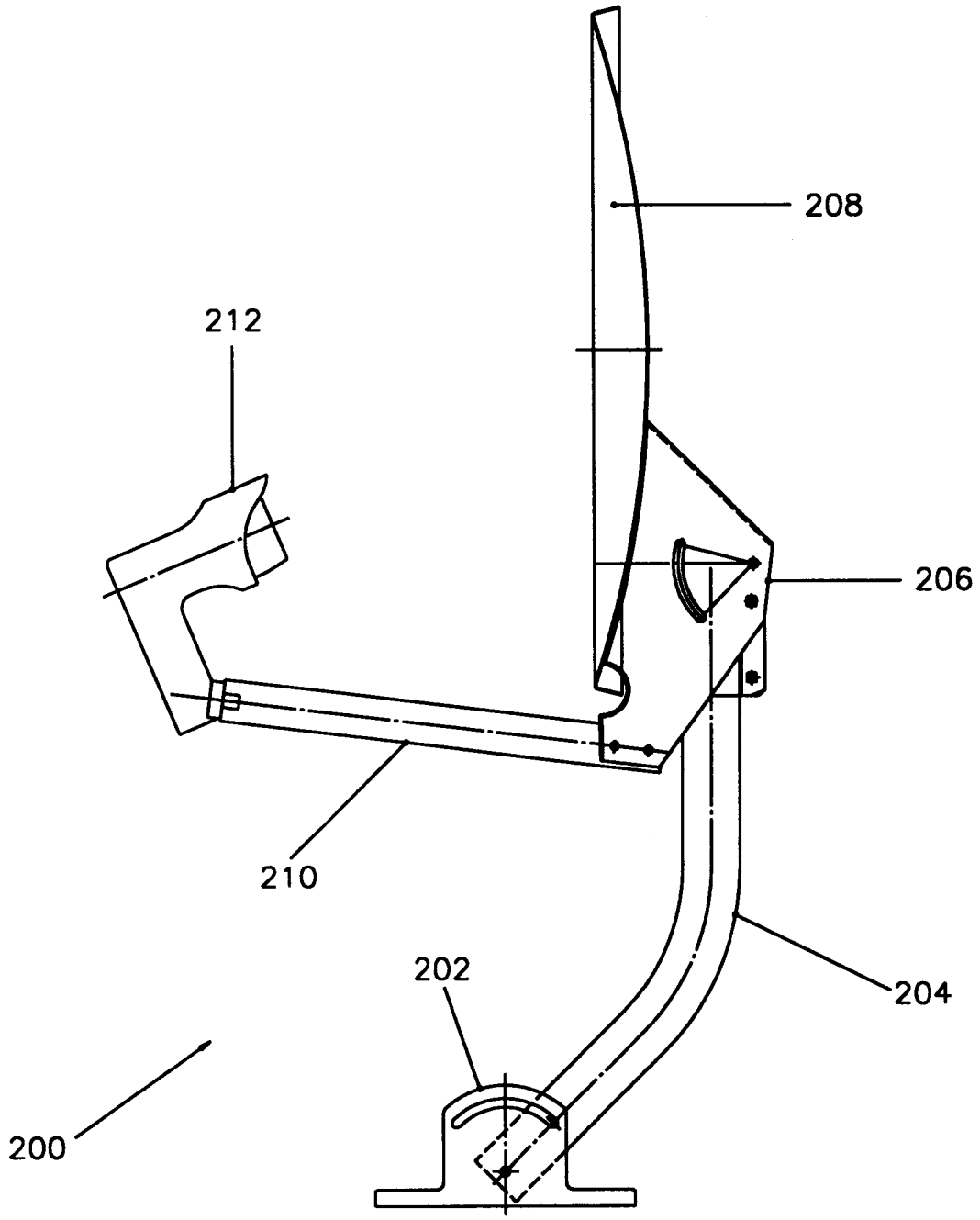
FIG. 2 is a drawing of a satellite signal receiving system incorporating the present invention.

FIG. 2 shows a satellite signal receiver system embodying the present invention. A receiver system 200 comprises a base mount 202, a mast 204, a dish bracket 206, a dish collector 208, an extending arm 210, and an LNBF module 212. The base mount 202 provides support for the receiver system 200. The mast 204 is coupled to the base mount 202 and the dish bracket 206. The dish bracket is in turn coupled to the dish collector 208 and to one end of the extending arm 210. The other end of the extending arm 210 is coupled to the LNBF module 212. By adjusting the positions of the dish collector 208 and the LNBF module 212, the dish collector 208 can be directed towards a satellite (or a group of satellites), and have the satellite signals collected towards the LNBF module.

The present invention provides a signal receiving apparatus for receiving electromagnetic signals transmitted from at least two distinct sources. The signal receiving apparatus comprises antenna means for collecting the electromagnetic signals from the at least two sources, at least two signal feeds for receiving the electromagnetic signals collected by the antenna means, and signal processing means for processing the electromagnetic signals received by the at least two signal feeds. The signal processing means includes at least two circuit boards for respectively processing the electromagnetic signals from each of the at least two signal feeds, and at least one spacer layer, disposed between the circuit boards, for reducing interference between the circuit boards.

Figure 3:
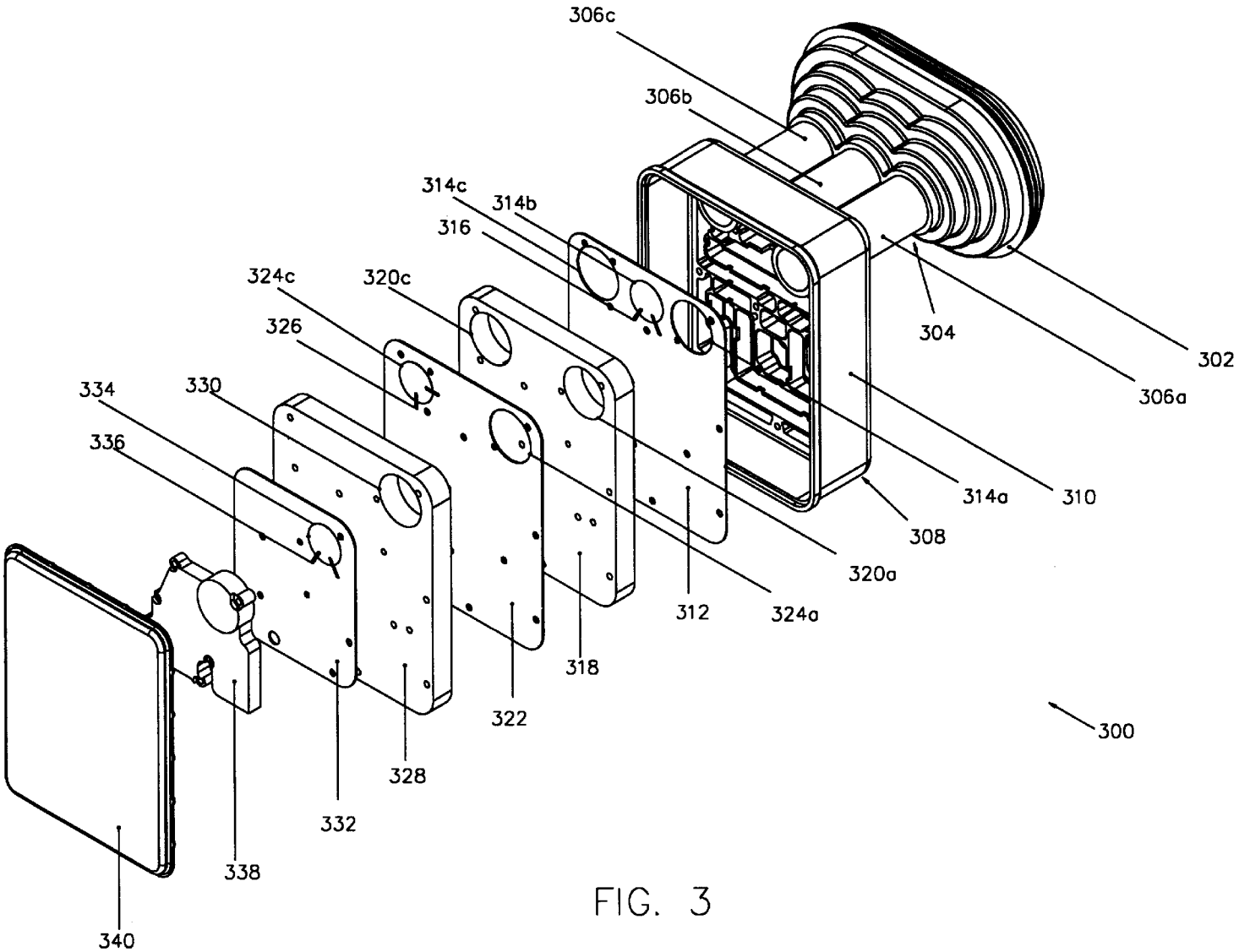
FIG. 3 is an exploded view of a multi-feed LNBF module utilizing the present invention.

FIG. 3 shows a preferred embodiment of the present invention. A triple-feed LNBF 300 comprises a triple-feed assembly 302, a triple-waveguide assembly 304, and a signal processing module 308. The triple-waveguide assembly 304 comprises a first waveguide 306*a*, a second waveguide 306*b*, and a third waveguide 306*c*. The shape of each waveguide can be changed according to practical considerations. The triple feed assembly 302 receives microwave signals collected by the antenna dish collector from three different satellites. The signals propagate through the triple-waveguide assembly 304 to the signal processing module 308.

The signal processing module 308 comprises a front housing 310, a first circuit board 312, a first spacer layer 318, a second circuit board 322, a second spacer layer 328, a third circuit board 332, a third spacer layer 338, and a back cover 340. The first, second, and third circuit board 312, 322, and 332 provide amplification and frequency conversion functions, which can be designed for processing the microwave signals in different frequency bands, or for those from different satellites in the same frequency band processed for different purposes, e.g., for different frequency conversion according to different satellites. The front housing 310 and back cover 340 encloses the circuit boards and spacer layers. A set of probe pins are provided on each circuit board to couple microwave signals to a processing circuitry on the circuit board. The set of probe pins are used for purposes of illustration only, it also can be a single probe pin or a pair of probe pins located in different relative angles for each circuit board, which depends on the polarized direction of the incoming signals. Several round openings and guides are provided in the first and second circuit boards and spacer layers to allow microwave signals to reach the second and third circuit boards without discontinuity.

A first set of probe pins 336 are mounted near the perimeter of an opening 334 of the third circuit board 332 to receive microwaves signals from the first waveguide 306*a*. A second set of probe pins 316 are mounted near the perimeter of an opening 314*b* of the first circuit board 312 to receive microwaves signals from the second waveguide 306*b*. A third set of probe pins 326 are mounted near the perimeter of an opening 324*c* of the second circuit board 322 to receive microwaves signals from the third waveguide 306*c*.

The openings 314*a* and 324*a* on the first and second circuit boards 312 and 322, and the guides 320*a* and 330 on the first and second spacer layers 318 and 328 are matched and aligned to the first waveguide 306*a* to allow microwave signals from the first waveguide 306*a* to reach the first set of probe pins 336. The opening 314*c* and the guide 320*c* are matched and aligned to the third waveguide 306*c* to allow microwave signals from the third waveguide 306*a* to reach the third set of probe pins 326.

The first spacer layer 318 provides support for the first circuit board 312, shielding individual part of the first circuit board 312 from internal interference, and isolation between the first circuit board 312 and the second circuit board 322. The first spacer 312 also provides ground reference for the second circuit board 322. The second spacer layer 328 provides support for the second circuit board 322, shielding individual part of the second circuit board 322 from internal interference, and isolation between the second circuit board 322 and the third circuit board 332. The second spacer 328 also provides ground reference for the third circuit board 332.

When the first, second, and third circuit boards 312, 322, and 332, and the first, second, and third spacer layers 318, 328, and 338 are stacked together, they result in a very compact module capable of receiving and processing microwave signals from three separate sources belonging to different frequency bands or same frequency band but for different signal processing.

Another embodiment of the present invention provides a signal receiving apparatus for receiving electromagnetic signals transmitted from more than three distinct sources. To avoid an unnecessarily complicated drawing, this embodiment is not illustrated but described by induction from FIG. 3. There is an antenna for collecting the electromagnetic signals from the plurality of sources, the requisite number of signal feeds (depending on the number of sources) and the required signal processors. The signal processors include separate circuit boards which are responsive to the signals from at least two of the plurality of signal feeds. The signal processors further include at least one spacer layer, disposed between the circuit boards, for reducing interference between the circuit boards.

Figure 4:
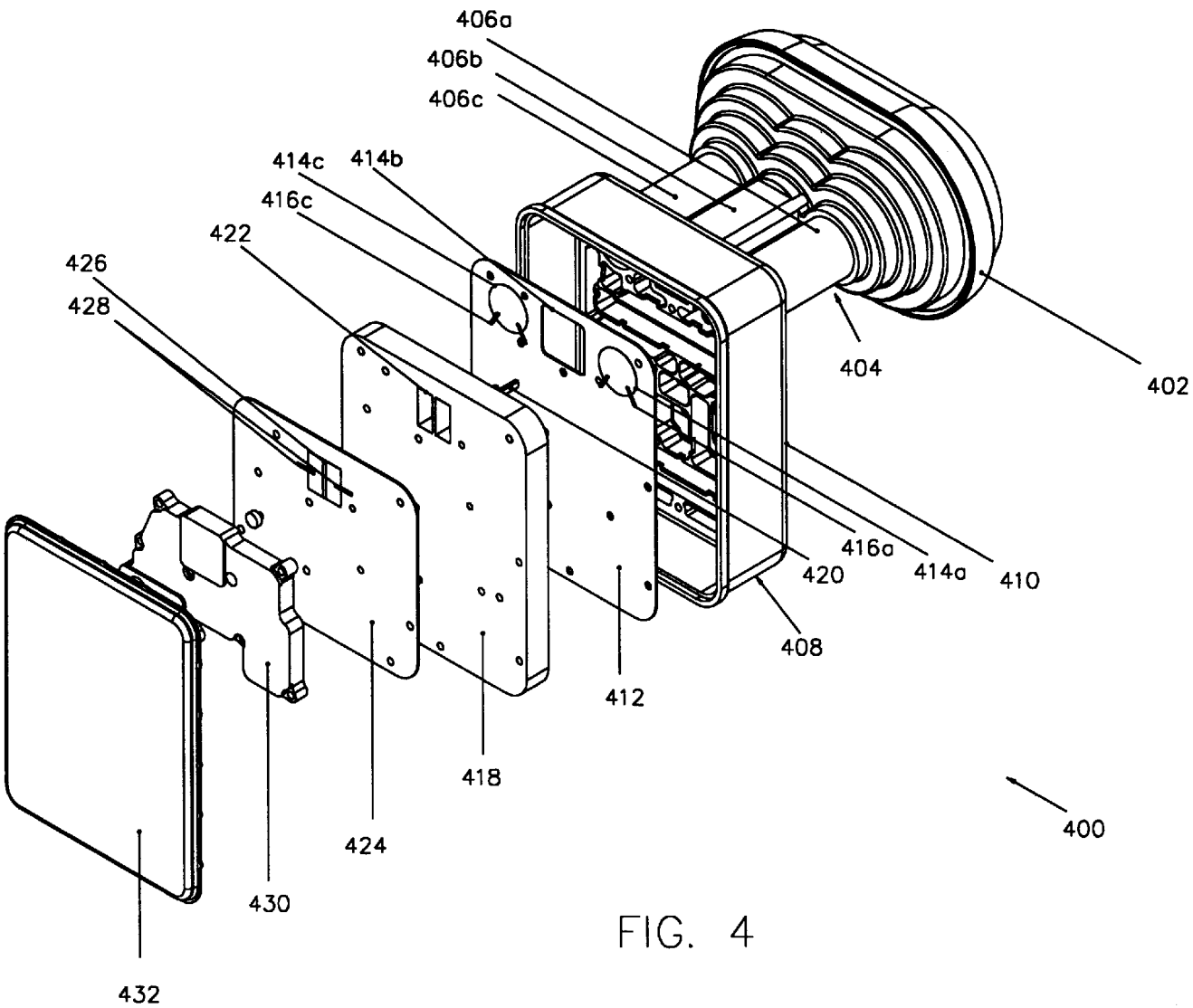
FIG. 4 is an exploded view of another multi-feed LNBF module utilizing the present invention.

FIG. 4 shows another embodiment of the present invention. A triple-feed LNBF 400 comprises a triple-feed assembly 402, a triple-waveguide assembly 404, and a signal processing module 408. The triple-waveguide assembly 404 comprises a first waveguide 406*a*, a second waveguide 406*b*, and a third waveguide 406*c*. The signal processing module 408 comprises a front housing 410, a first circuit board 412, a first spacer layer 418, a second circuit board 424, a second spacer layer 430, and a back cover 432.

The front housing 410 and back cover 432 encloses the circuit boards and spacer layers. Several round openings and guides are provided in the first circuit board and spacer layer to allow microwave signals to reach the second circuit board.

A first set of probe pins 416*a* are mounted near the perimeter of an opening 414*a* of the first circuit board 412 to receive microwaves signals from the first waveguide 406*a*. A second set of probe pins 428 are mounted near the perimeter of an opening 426 of the second circuit board 424 to receive microwaves signals from the second waveguide 406*b*. A third set of probe pins 416*c* are mounted near the perimeter of an opening 414*c* of the first circuit board 412 to receive microwaves signals from the third waveguide 406*c*.

The first and third waveguides 406*a* and 406*c* receive microwave signals of the same frequency band. If the microwave signals received from the first and third waveguides 406*a* and 406*c* are processed identically, they can be processed on the same circuit board. A switching circuitry on the first circuit board 412 may be used to provide a mechanism for selection between broadcast signals of two satellites. In accordance with the embodiment of the present invention, it needs only a single circuit board to receive the microwave signals from different satellites belonging to the same frequency band for identically signal processing.

The openings 414*b* and 428 on the first and second circuit boards 412 and 424, and the guide 422 on the second spacer layer 418 are matched and aligned to the second waveguide 406*b* to allow microwave signals from the second waveguide 406*b* to reach the second set of probe pins 428. The first spacer layer 418 provides support for the first circuit board 412, shielding individual part of the first circuit board 412 from internal interference, and isolation between the first circuit board 412 and the second circuit board 424. The first spacer 418 also provides ground reference for the second circuit board 424. A polarizer 420 is provided near the guide 422 on the second spacer 418 to convert the polarization of incoming signals from circularly polarized signals to linearly polarized signals.

When the first and second circuit boards 412 and 424, and the first and second spacer layers 418 and 430 are stacked together, they become a very compact module capable of receiving and processing microwave signals from three separate sources belonging to different frequency bands and having different polarization.

The present invention provides a compact multiple-feed signal receiver having multi-layer structure to integrate circuit boards for different frequency bands within a limited cross-section and to isolate these boards from frequency interference with one another. Further, it can receive not only the microwave signals from different satellites in different frequency bands but also from different satellites belonging to the same frequency band for different signal processing.

While the above is a full description of the specific embodiments, various modifications, alternative constructions and equivalents may be used. For example, the shape of waveguides, and the number of feeds and waveguides can be changed according to practical considerations. The location and the number of the probe pins and can also be altered. The signal processing module can be modified to provide different functions.

Therefore, the above description and illustrations should not be taken as limiting the scope of the present invention which is defined by the following claims.

What is claimed is:

1. A signal receiving apparatus for receiving electromagnetic signals transmitted from at least two distinct sources, comprising:

antenna means for collecting the electromagnetic signals from said at least two sources;

at least two signal feeds for receiving the electromagnetic signals collected by said antenna means; and signal processing means for processing the electromagnetic signals received by said at least two signal feeds, said signal processing means being a multi-layer stackable structure having at least two circuit boards for respectively processing the electromagnetic signals from each of said at least two signal feeds, and at least one spacer layer, disposed between said circuit boards, for reducing interference between electromagnetic signals from said circuit boards.

2. The signal receiving apparatus of claim 1 further comprising circuit means for amplifying the electromagnetic signals from each of said at least two signal feeds.

3. The signal receiving apparatus of claim 2, wherein said circuit means further responsible for converting the frequency of the electromagnetic signals from each of said at least two signal feeds.

4. The signal receiving apparatus of claim 2 further comprising:

a waveguide functionally coupled to one of said signal feeds; and a probe pin functionally coupled to said waveguide and to said signal processing means;

wherein the electromagnetic signals are transmitted via said signal feed, said waveguide, and said probe pin to said signal processing means.

5. The signal receiving apparatus of claim 2 further comprising:

a waveguide functionally coupled to one of said signal feeds; and a set of orthogonal probe pins, functionally coupled to said waveguide and to said signal processing means, for receiving orthogonally polarized signals transmitted in said waveguide;

wherein said signals are transmitted via said signal feed, said waveguide, and said probe pins to said signal processing means.

6. The signal receiving apparatus of claim 1, wherein said signal processing means is a LNBF module.

7. The signal receiving apparatus of claim 1, wherein one of said at least two circuit boards has at least one opening to allow the electromagnetic signals from one of said at least two signal feeds to pass through and be received by the proximate circuit board.

8. A signal receiving apparatus for receiving electromagnetic signals transmitted from at least three distinct sources, comprising:

antenna means for collecting the electromagnetic signals from said at least three distinct sources;

at least three signal feeds for receiving the electromagnetic signals collected by said antenna means; and signal processing means for processing the electromagnetic signals received by said at least three signal feeds, said signal processing means being a multi-layer stackable structure having at least two circuit boards, one of said at least two circuit boards being responsive to the electromagnetic signals from at least two of said at least three signal feeds, and at least one spacer layer, disposed between said circuit boards, for reducing interference between electromagnetic signals from said circuit boards.

9. The signal receiving apparatus of claim 8 further comprising circuit means for amplifying the electromagnetic signals from each of said at least three signal feeds.

10. The signal receiving apparatus of claim 8, wherein said at least two circuit boards further responsible for selecting the electromagnetic signals between said two of said at least three signal feeds.

11. The signal receiving apparatus of claim 9, wherein said circuit means further responsible for converting the frequency of the electromagnetic signals from each of said at least three signal feeds.

12. The signal receiving apparatus of claim 9 further comprising:

a waveguide functionally coupled to one of said signal feeds; and a probe pin functionally coupled to said waveguide and to said signal processing means;

wherein the electromagnetic signals are transmitted via said signal feed, said waveguide, and said probe pin to said signal processing means.

13. The signal receiving apparatus of claim 9 further comprising:

a waveguide functionally coupled to one of said signal feeds; and a set of orthogonal probe pins, functionally coupled to said waveguide and to said signal processing means, for receiving orthogonally polarized signals transmitted in said waveguide;

wherein said signals are transmitted via said signal feed, said waveguide, and said probe pins to said signal processing means.

14. The signal receiving apparatus of claim 8, wherein said signal processing means is a LNBF module.

15. The signal receiving apparatus of claim 8, wherein one of said at least two circuit boards has at least one opening to allow the electromagnetic signals from one of said at least three signal feeds to pass through and be received by the proximate circuit board.

16. A signal receiving apparatus for receiving electromagnetic signals transmitted from at least two distinct sources, and collected by a single antenna, comprising:

a first signal feed for receiving signals of a first frequency band;

a second signal feed for receiving signals of a second frequency band;

a first circuit board having processing circuitry for processing the signals received by said first signal feed, said first circuit board further having an opening for the signals to pass through;

a second circuit board having processing circuitry for processing the signals received by said second signal feed; and a spacer layer disposed between said first and second circuit boards to provide signal isolation, said spacer layer having a guide for guiding signals through said spacer layer;

wherein said first, second circuit board and said spacer layer form a multi-layer stackable structure, and said opening of said first circuit board and said guide of said spacer layer are aligned to said second signal feed to allow signals received by said second signal feed to pass through to said second circuit board.

17. The signal receiving apparatus of claim 16 further comprising:

a first waveguide functionally coupled to said first signal feed and said first circuit board for guiding the signals received by said first signal feed towards said first circuit board; and a second waveguide functionally coupled to said second signal feed and said second circuit board for guiding the signals received by said second signal feed towards said second circuit board.

18. The signal receiving apparatus of claim 16, wherein said first circuit board comprises processing circuitry for amplifying the signals.

* * * * *